US005441167A

United States Patent [19]

Shigeru

[11] Patent Number: 5,441,167

[45] Date of Patent: Aug. 15, 1995

[54] STORAGE AREA AND HINGE STRUCTURE

[75] Inventor: Yabuya Shigeru, Nakashima, Japan

[73] Assignee: Toyoda Gosei Co., Ltd., Japan

[21] Appl. No.: 170,935

[22] Filed: Dec. 21, 1993

[30] Foreign Application Priority Data

Dec. 21, 1992 [JP] Japan ..... 4-092126 U

[51] Int. Cl.[6] ..... B65D 43/16; E05D 7/083; E05D 11/06

[52] U.S. Cl. ..... 220/334; 16/374; 16/387

[58] Field of Search ..... 220/335, 334, 342, 343; 16/374, 387

[56] References Cited

U.S. PATENT DOCUMENTS 4,934,750 6/1990 Eichler et al. .
5,067,625 11/1991 Numata ..... 220/335 X
5,144,720 9/1992 Aihara et al. .

FOREIGN PATENT DOCUMENTS 641448 4/1964 Belgium ..... 16/374
1961087 8/1978 Germany ..... 220/335
63-98976 6/1988 Japan .

*Primary Examiner*—Allan N. Shoap
*Assistant Examiner*—Nathan J. Newhouse
*Attorney, Agent, or Firm*—Cushman Darby & Cushman

[57] ABSTRACT

A storage area and hinge structure having two stopper portions for opening and closing a lid relative to an opening in the box. The hinge has two stopper portions cooperating with the box for relieving force on the hinge and storage area when the lid is opened fully.

7 Claims, 5 Drawing Sheets

STORAGE AREA AND HINGE STRUCTURE

BACKGROUND OF THE INVENTION

1. Field of the Invention

The present invention relates to an automobile storage area and hinge structure for the lid, and is particularly suitable for use with an automobile console box or an automobile glove box or the like.

2. Description of the Prior Art

A conventional hinge structure for a box or storage area or container, such as a glove box or a center console, has a hinge body, a box body and supporting members which are mounted on the box body and which are able to turn around the hinge body. The hinge body has one stopper portion for stopping the swinging open of the box closer, for example, a lid. A hinge structure of that kind is disclosed in Japanese Utility Model Laid-open publication No. Sho 63-98976.

However, in such a case, there is only one stopper portion and when the swinging of the lid is stopped, that one stopper portion of the hinge body comes into contact with a stopper portion of each supporting member on the box body, and an excessive force is exerted on that one stopper portion of the hinge body or on each stopper portion of the supporting members.

Therefore, a hinge structure is needed that has a structure able to disperse the force exerted on the hinge body or the box body side member like the supporting member when the lid is swung fully open.

SUMMARY OF THE INVENTION

An object of the present invention is to provide a hinge structure for a globe box or a center console lid with capability of dispersing the force exerted on the hinge body or box body side supporting portion when the swinging of the lid is fully opened.

In accordance with the invention, the object is achieved in that the hinge structure has two separate stopper portions for relieving the force on the hinge and storage area.

Other objects, features, and characteristics of the present invention, as well as the methods and operation and functions of the related elements of the structure, will become apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Preferred embodiments of the invention for use in an automobile console box will now be described referring to the accompanying drawings.

First embodiment: FIGS. 1 to 5

Figure 1:
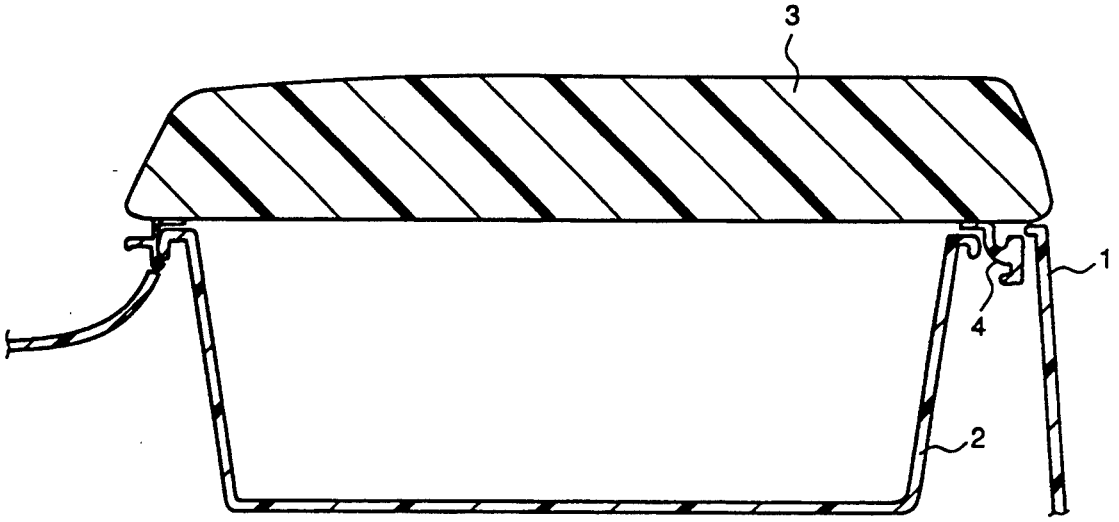
FIG. 1 is a cross sectional view showing a lid attached to the console box according to a first embodiment of the present invention.

As shown in FIG. 1, a console box main body 1 has a substantially rectangular parallelepiped box part 2 which has an opening at the upper portion. A lid 3 as a box closer is able to open and close the opening of the box part 2. The lid 3 is supported at the console box main body 1 through a hinge 4 which allows lid 3 to swing open and closed.

Figure 2:
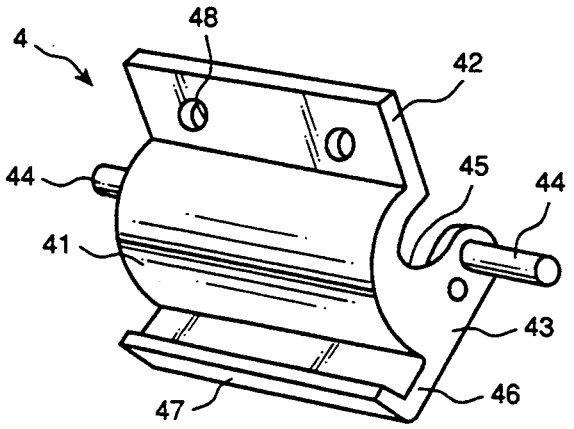
FIG. 2 is a perspective view of a hinge body of the first embodiment of the present invention.

As shown in FIG. 2, the hinge 4 has a connecting portion 42 which has holes 48 for connection to lid 3 by a fastener such as a screw. Hinge 4 also has an arcuate hinge body 41 which includes a pair of side walls 43 and a pivot member 44 which protrude from each side wall 43, respectively, to be supported at the console box main body 1 to allow lid 3 to swing open and closed. A first stopper portion 45 is formed as a bottom part of a recess in both side walls 43 between the pivot 44 and the connecting portion 42, respectively. A second stopper portion 46 protrudes substantially perpendicularly to the opposite edge portion of the arcuate hinge body 41. The second stopper portion 46 has a strip 47 on the end of the perpendicular protrusion.

Figure 3:
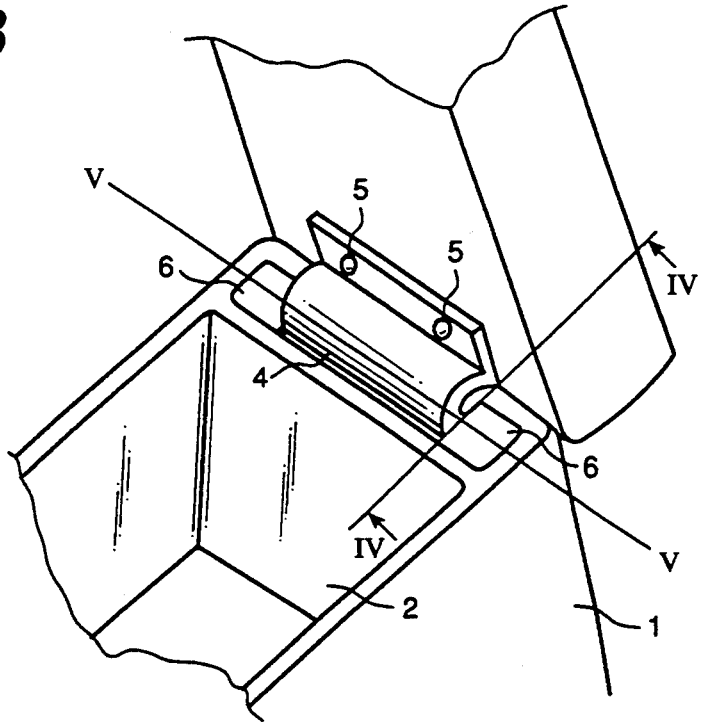
FIG. 3 is a partial perspective view of the first embodiment of the present invention showing an open lid, the hinge body and the principal area of the box body.
Figure 5:
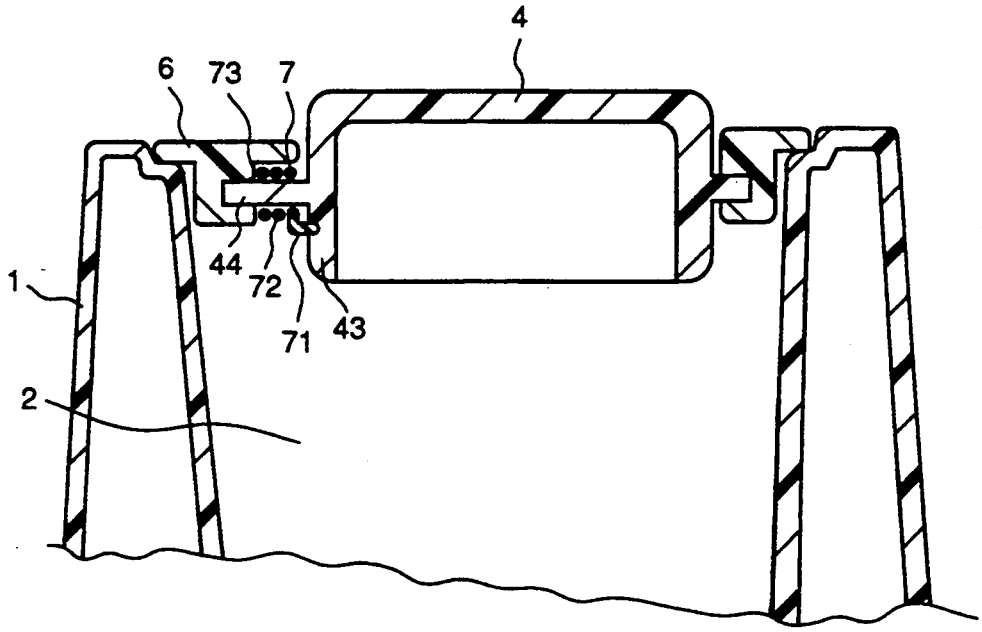
FIG. 5 is a partial cross sectional view of the first embodiment of the present invention, which is taken along a line V—V in FIG. 3.

As shown in FIG. 3, hinge 4 is connected at the rear interior surface of lid 3 by screws 5. FIG. 5 shows that pivots 44 are supported by bearings 6 which in turn are supported by the console box main body 1.

A torsion coil spring 7 is mounted between the hinge 4 and the bearing 6 to bias lid 3 toward its open position. One end 71 of the torsion coil spring 7 is connected at the side wall 43 of the hinge body 41, coil portion 72 is mounted around the pivot 44, and the opposite end 73 of the torsion coil spring 7 is connected at the bearing 6. Consequently, when lid 3 is unlatched by a mechanism not shown, it swings open and is prevented from closing by the biassing force of the torsion coil spring 7.

Figure 4:
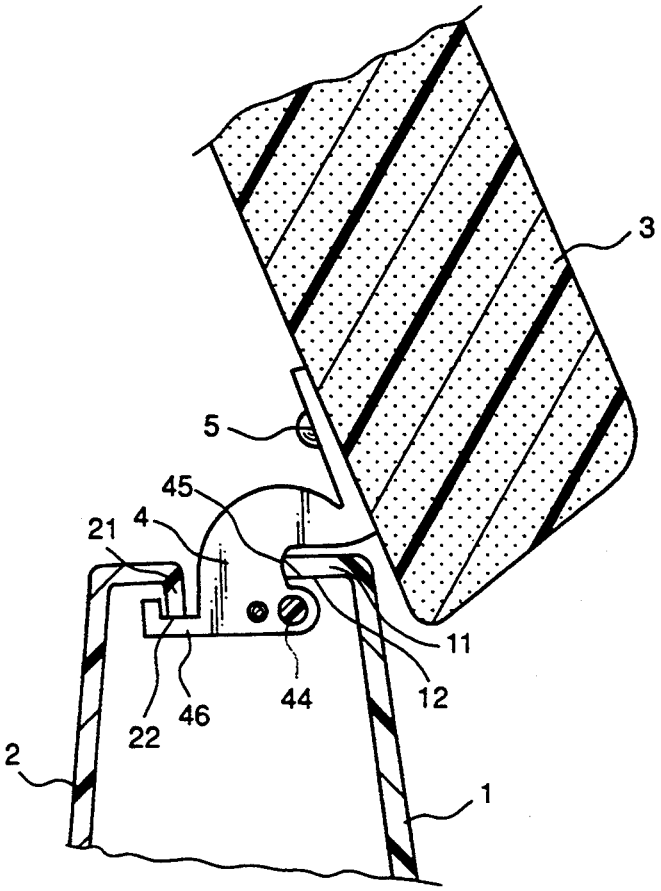
FIG. 4 is a partial cross sectional view of the first embodiment of the present invention, which is taken along a line IV—IV in FIG. 3.

The motion of the hinge 4 is now explained. FIG. 4 is an enlarged view at the hinge 4 portion on the console box main body 1 when the lid 3 is fully open. In this situation, the first stopper portion 45 on each side of the hinge 4 comes into contact with a front stop surface 12 of a stopper portion 11 of the console box main body 1, and simultaneously, the second stopper portion 46 of the hinge 4 comes into contact with a lower end stop surface 22 of a stopper portion 21 of the console box main body 1. Stopper portion 11 is formed at the upper portion of a rear wall of the console box main body 1, and stopper portion 11 protrudes forwardly from the rear wall in a nearly perpendicular direction. Stopper portion 21 extends rearwardly from the upper portion of a rear wall of the box part 2, and then protrudes downwardly from the extending portion.

Therefore, when the swinging of lid 3 is stopped by the first and second stopper portions 45 and 46, the force on the pivots 44 is reduced by the first stopper portion 45 and the second stopper portion 46.

A hinge structure which has only one stopper portion, like a conventional hinge structure, exerts a force at the pivot when the swinging of lid is stopped. The force is produced as a moment pivoting about the stopper portion, thereby exerting the force on the hinge and/or box, tending to damage the hinge or box. However, the hinge 4 of this embodiment is formed with two stopper portions such as the first stopper portion 45 and the second stopper portion 46, and hence when the swinging of lid 3 is stopped, the moment which is produced at one stopper portion is received by the other stopper portion. Consequently, the force at the pivots 44 is reduced.

Figure 6:
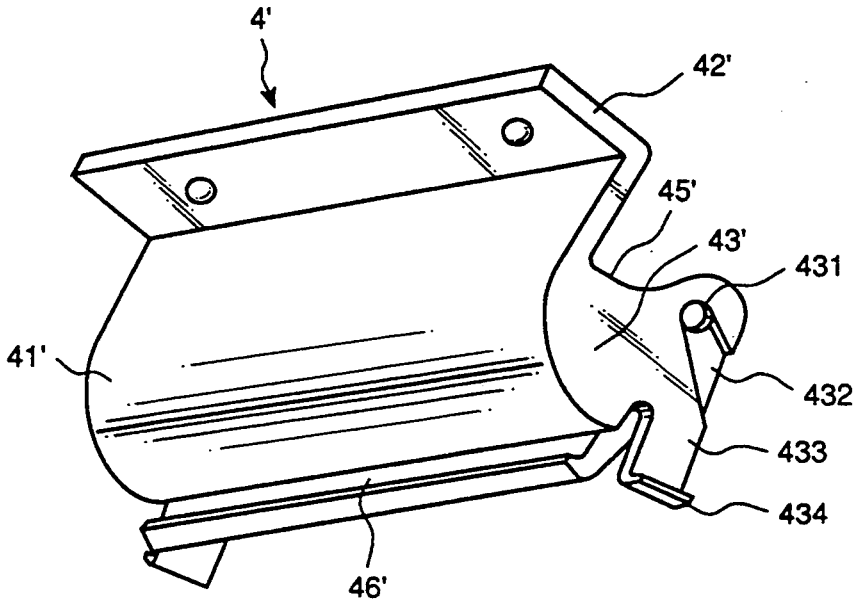
FIG. 6 is a perspective view of a hinge body of a second embodiment of the present invention.
Figure 7:
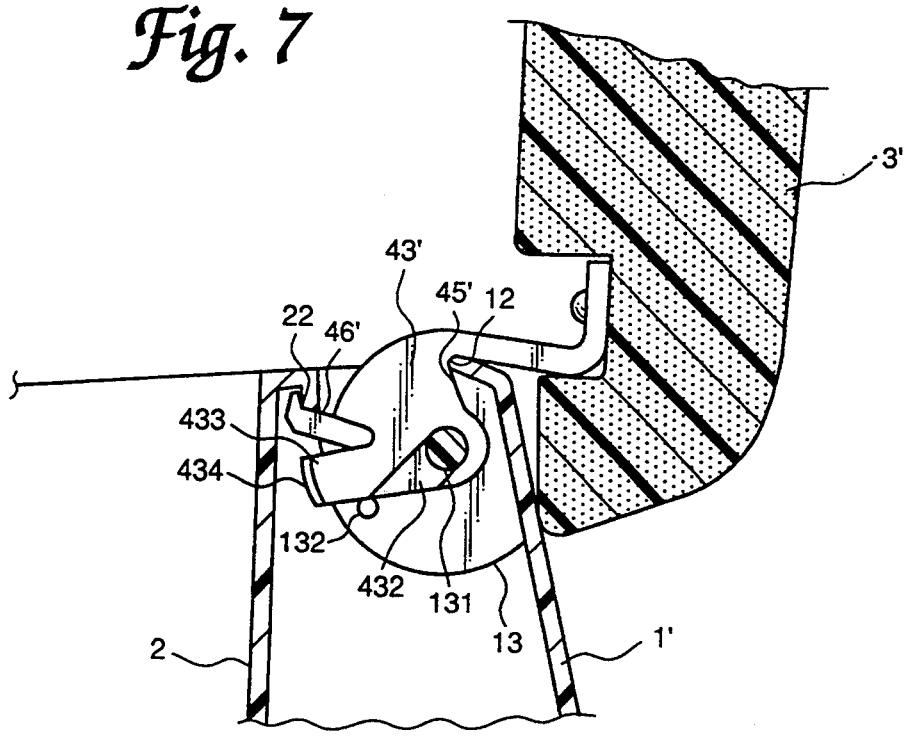
FIG. 7 is a partial cross sectional view of the second embodiment of the present invention, which is a view similar to the FIG. 4 view.
Figure 8:
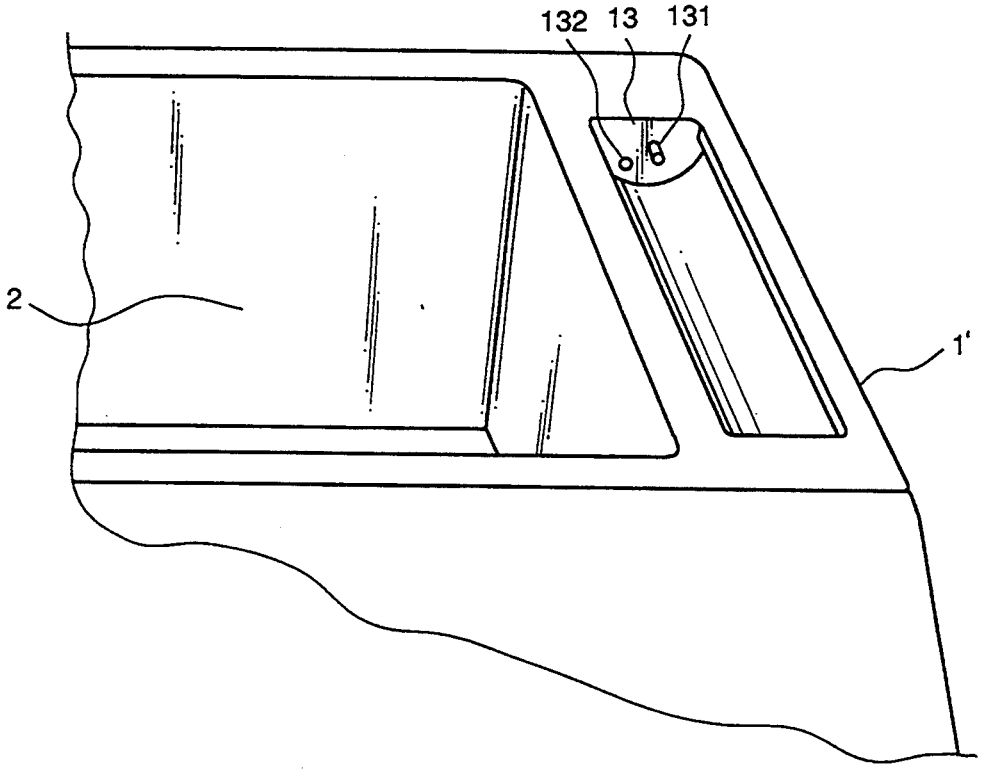
FIG. 8 is a partial perspective view of a second embodiment of the present invention showing a supporting member on the box body of the console box.

Second embodiment: FIGS. 6 to 8

In FIGS. 6 to 8, a hinge 4' of the second embodiment has bearing holes 431 on both side walls 43' of a hinge body 41', guide gutters 432 which easily guide both pivots 131 provided on the console box main body 1' to the bearing holes 431, respectively and a guide projection 434 which is formed at an extending portion 433 from both side walls 43' of the hinge body. The first stopper portion 45' is formed as a bottom part of a recess located between the bearing hole 431 and the connecting portion 42'. The remaining structure of the hinge 4' of the second embodiment is the same as in the first embodiment. On the other hand, the console box main body 1' of the second embodiment has two supporting plates 13 as side walls at opposite ends of an opening which receives the hinge 4' of the second embodiment. Each supporting plate 13 has a pivot pin 131 at the counter portion of each bearing hole 431 of the hinge 4'. The lower edge of each supporting plate 13 is arcuate and cooperates with the guide projection 434 of the hinge body 41'. Each supporting plate 13 is resilient and has a projection in the form of a bump 132 for providing a click-stop feeling as the lid 3' becomes fully open. The remaining structure of the console box main body 1' of the second embodiment is the same as the structure of the console box main body 1 of the first embodiment.

The hinge is easily assembled by insertion into the opening of the console box main body 1' so that each pivot pin 131 on the supporting plates 13 is inserted into the guide gutter 432 and with further push along the guide gutter 432, the pivot pins 131 snap into the bearing holes 431, respectively. Assembly of the hinge 4' to the console box main body 1' is helped by the resilient character of the supporting plates 13 which are spring outward for insertion of pivot pins 131 into the guide gutters 432, respectively. Preferabley, the side walls 43' of the hinge 4' also have a resilient character to aid in the hinge installation process. Because of the rotatable guiding structure including guide projection 434, the swinging of lid 3' is more smooth. Projection 132 on both supporting plates 13 slides on a surface of the respective side wall 43' when the lid 3' is swinging, and when the swinging of lid 3' is about finished, the remaining movement of the hinge moves the projection 132 to the non-contact portion of the side wall 43' as shown in FIG. 7. During that last movement, the click-stop feeling is created. That is also when the two stopper portions 45' and 46' prevent any further opening movement of the hinge and also prevent exertion of a force on the hinge. Therefore, the same function and result are obtained in the second embodiment as in the first embodiment.

Figure 9:
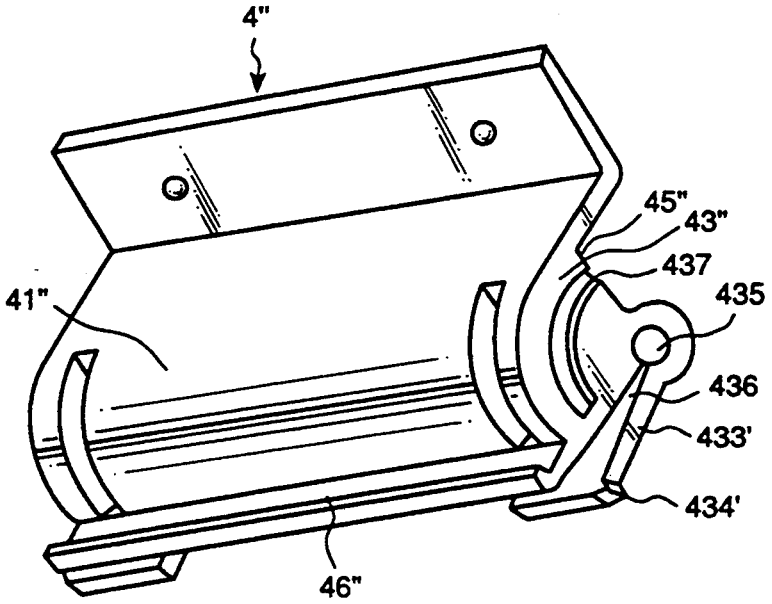
FIG. 9 is a perspective view of a hinge body of a third embodiment of the present invention.
Figure 10:
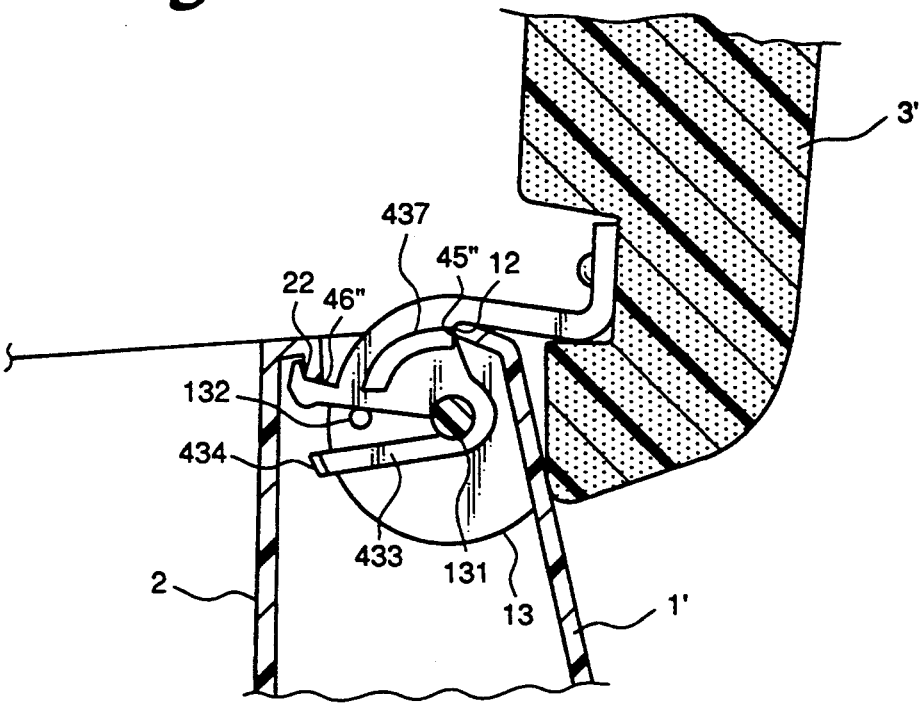
FIG. 10 is a partial cross sectional view of the third embodiment of the present invention, which is a view similar to the FIG. 4 view.

Third embodiment: FIGS. 9 and 10

In FIGS. 9 and 10, a hinge 4'' of the third embodiment has bearing holes 435 and cut out portions 436 in both side walls 43' of the hinge. The cut out portions 436 lead to the bearing holes 435 and guide the pivots 131 to the bearing holes 435. Both side walls 43'' also have a slot 437 for receiving a respective projection 132 until lid 3' is nearly fully open. At that time the side walls 43'' ride over the projection 132 until lid 3' is fully open as shown in FIG. 10. Both stopper portions 45'' and 46'' prevent any further opening of lid 3'. The remaining structure of the hinge 4'' of the third embodiment is the same structure of the hinge 4' of the second embodiment. Similarly, the console box main body 1' of the third embodiment has the same structure as the console box main body 1' of the second embodiment.

Again, the hinge 4'' is easily assembled into an opening of the console box main body 1' so that the pivot pins 131 on the supporting plates 13 are inserted into the cut out portions 436 and with further push the pins 131 snap into the bearing holes 435. Assembly of the hinge 4'' to the console box main body 1' is aided by the resilient character of the supporting plates 13 and preferably also of the side walls 43'. Since the projections 132 freely move along slots 437, the swinging of lid 3' is more smooth. Furthermore, the same function and result are obtained as in the first and second embodiments.

Therefore, this invention produces the result of dispersing the force exerted on the hinge body or a box body side member by the first and second stopper portions when the lid is stopped at its fully open position.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A box and hinge structure comprising:

a box main body having a box part with an opening, two stopper portions and a supporting portion;

a lid for opening and closing said opening of the box part;

a hinge having an arcuate hinge body and extending therefrom a connecting portion connected to said lid, said hinge body having opposing side walls, a first stopper portion formed on at least one of said side walls, a second stopper portion extending from said hinge body remotely from said first stopper portion; and a pair of pivot members provided on one of said hinge and said box part and cooperating bearings provided on the other of said hinge and said box part so that said hinge is rotatably mounted relative to said box body permitting rotation of said hinge and said lid;

said two stopper portions in said box main body cooperating with said first and second stopper portions, respectively, to stop rotation of said hinge when said lid is fully open.

2. The box and hinge structure according to claim 1, wherein said pivots are formed on said hinge body and said bearings are mounted on said box main body.

3. The box and hinge structure according to claim 1, wherein said pivots are formed on said box main body and said bearings are formed on said hinge body.

4. The box and hinge structure according to claim 1, further comprising a torsion coil spring supported between said lid and said box main body for urging said lid open.

5. A box and hinge structure comprising:

a main box body having a box part with an opening, two stopper portions adjacent a supporting portion including spaced apart bearing assemblies;

a lid for opening and closing said opening of the box part; and a hinge having an arcuate hinge body and extending therefrom a connecting portion connected to said lid, said hinge body having opposing side walls, a pivot protruding from each of said opposing side walls, each pivot being supported on said box main body through one of said bearing assemblies so that said lid can swing between open and closed positions, a first stopper portion formed as a bottom part of a recess on at least one of said side walls, between said pivot and said connecting portion, and a second stopper portion protruding from an edge portion of said hinge body and having a substantially perpendicular surface; wherein said two stopper portions in said box main body cooperate with said first and second stopper portions, respectively, to stop rotation of said hinge when said lid is fully open.

6. The box and hinge structure according to claim 5, further comprising a torsion coil spring supported between said lid and said box main body for urging said lid open.

7. A box and hinge structure comprising:

a console box main body having a box part with an opening, two stopper portions and a pair of supporting portions each having a pivot, respectively;

a lid for opening and closing said opening of the box part; and a hinge having an arcuate hinge body and extending therefrom a connecting portion connected to said lid, said arcuate hinge body having opposing side walls having bearing holes, respectively, for receiving a pivot therein to permit swinging of said lid between open and closed positions, a first stopper portion formed as a bottom part of a recess on at least one of said side walls, between said bearing hole and said connecting portion, and a second stopper portion protruding from an edge portion of said hinge body and having a substantially perpendicular surface; wherein said two stopper portions in said box main body cooperate with said first and second stopper portions, respectively, to stop rotation of said hinge when said lid is fully open.

* * * * *